United States Patent [19]

Pickett et al.

[11] Patent Number: 4,562,706

[45] Date of Patent: Jan. 7, 1986

[54] MECHANICAL RELOCKER FOR LOCKING BOLTS

[75] Inventors: Teddy L. Pickett, Ventura; Henry L. Self, Oxnard, both of Calif.

[73] Assignee: The United States of America as represented by the Secretary of the Navy, Washington, D.C.

[21] Appl. No.: 577,100

[22] Filed: Feb. 6, 1984

[51] Int. Cl.[4] ..... E05B 63/00

[52] U.S. Cl. ..... 70/1.5; 70/416; 70/422; 109/63.5

[58] Field of Search ..... 292/57–62; 70/416, 418, 420, 422, 1.5, 1.7; 109/63.5

[56] References Cited

U.S. PATENT DOCUMENTS

| | | | |
|---|---|---|---|
| 1,376,122 | 4/1921 | Songey | 292/57 |
| 1,458,271 | 6/1923 | Clark | 70/1.5 |
| 1,593,684 | 7/1926 | Anakin | 292/57 X |
| 1,711,972 | 5/1929 | Seiler | 292/62 |
| 2,425,262 | 8/1947 | Newton | 70/1.5 |
| 2,609,679 | 9/1952 | Bremer et al. | 70/422 X |
| 3,076,420 | 2/1963 | McClellan | 70/416 X |
| 3,397,000 | 8/1968 | Yoshitaka | 292/61 |
| 3,637,277 | 1/1972 | Krug et al. | 70/422 X |
| 4,393,790 | 7/1983 | Bagwell | 70/422 X |

FOREIGN PATENT DOCUMENTS

| | | | |
|---|---|---|---|
| 650544 | 10/1962 | Canada | 70/1.5 |
| 2328828 | 5/1977 | France | 70/418 |

*Primary Examiner*—Robert L. Wolfe
*Assistant Examiner*—Russell W. Illich
*Attorney, Agent, or Firm*—Robert F. Beers; Joseph M. St.Amand; Thomas M. Phillips

[57] ABSTRACT

A torsion spring longitudinally rotates a locking bolt when the bolt actuating linkage is severed. A woodruff key or the like is upstanding from a surface of the bolt. When the linkage is undamaged, the key slides with the bolt through a slot on the lock frame. When the bolt is rotated by the spring, it is locked in the rotated position by a locking pawl. In the rotated position, the key is out of registry with the slot and the bolt cannot be withdrawn from its extended, locking position. A second embodiment replaces the key with a recess in the bolt into which a locking pawl engages to prevent movement of the locking bolt.

8 Claims, 9 Drawing Figures

MECHANICAL RELOCKER FOR LOCKING BOLTS

BACKGROUND OF THE INVENTION

1. Field of the Invention

This invention relates to relocking mechanisms for the doors of safes, vaults, strong rooms, and like security closures, herein referred to as safes. A safe door locking mechanism typically comprises an elongated bolt mounted for reciprocation between a forward locking position and a rearward unlocking position, bolt-operating means usually including a handle on the outside of the door, and locking means operable to secure the bolt in its forward locking position. The locking means may take the form of one or more combination locks. Additional security may be provided by means of a relocking mechanism which is normally retained in a waiting condition but, in the event of forcible attack on the locking means, becomes operable to secure the bolt in its forward locking position.

2. Description of the Prior Art

Present lock bolt systems are mechanically driven by the lock through rack gear or cams and linkages. Any locking system of these types can be by-passed by cutting small holes in the door, severing the bolt actuating linkage, and retracting the lock bolts.

SUMMARY OF THE INVENTION

The present invention provides for the relocking of a lock bolt in the event of attack on the safe and the bolt actuating linkage is severed. The bolt which is being urged to rotate is prevented from rotating by the bolt actuating linkage means. The bolt is configured so that it will reciprocate when in the non-rotated position, but will be prevented from moving from the locked positions when the bolt is in the rotated position. A latch means is actuated to prevent the bolt from being rotated back into its position of alignment for reciprocal movement.

Accordingly, an object of the invention is the provision of a relocking mechanism for a lock bolt to automatically hold the lock bolt in its extended position in the event an attempt is made to by-pass the lock and its actuating linkage is severed.

Other objects, advantages and novel features of the invention will become apparent from the following detailed description of the invention when considered in conjunction with the accompanying drawings wherein:

DESCRIPTION OF THE PREFERRED EMBODIMENTS

Figure 1:
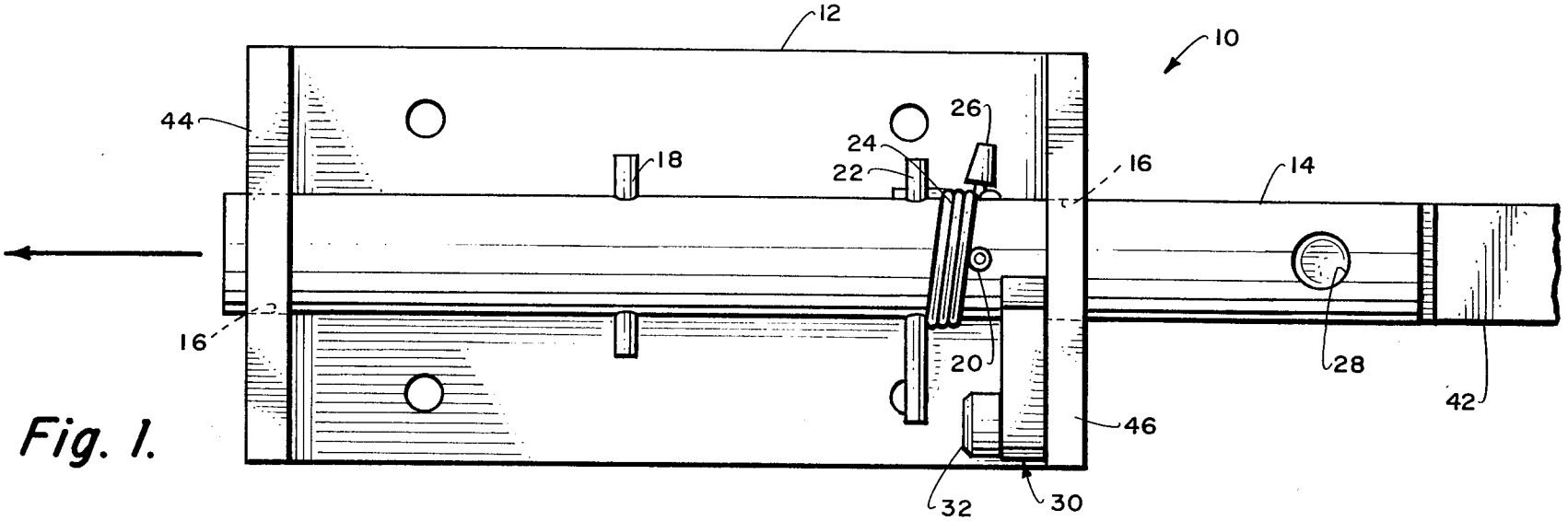
FIG. 1 is a plan view of one embodiment showing the bolt in the nonextended position.

Referring to the drawings wherein there is shown in FIG. 1 the relocking assembly 10. A mounting bracket 12 is provided with holes 16 through which locking bolt 14 can reciprocate when actuated.

Figure 2:
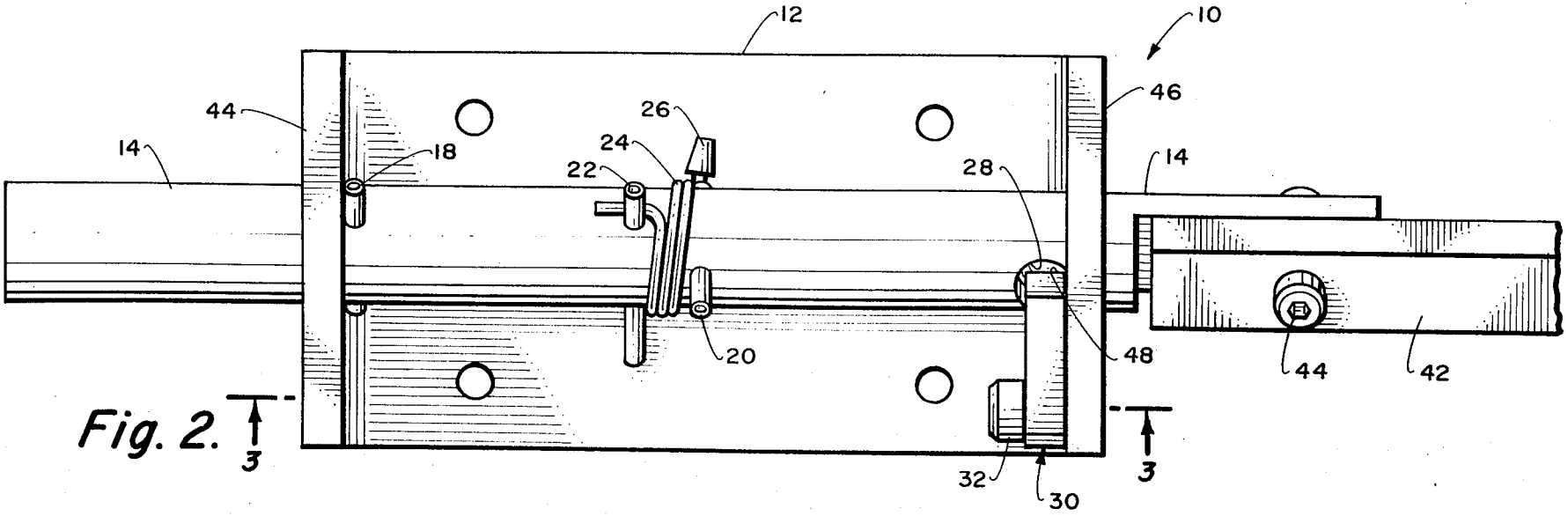
FIG. 2 is a plan view of the embodiment of FIG. 1 showing the bolt in the extended and rotated position.
Figure 3:
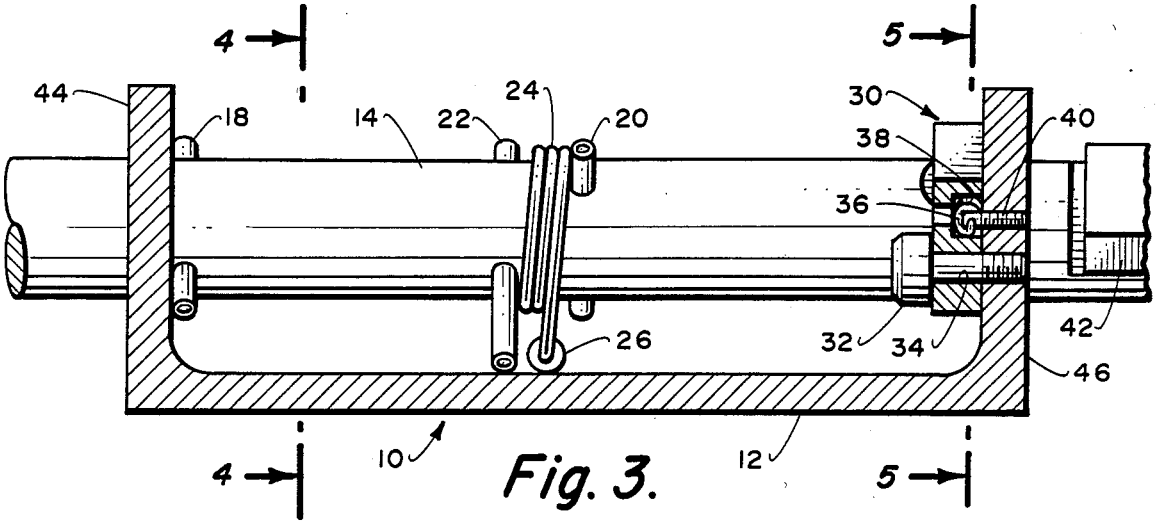
FIG. 3 is a section view of FIG. 2 taken along the lines 3—3.
Figure 4:
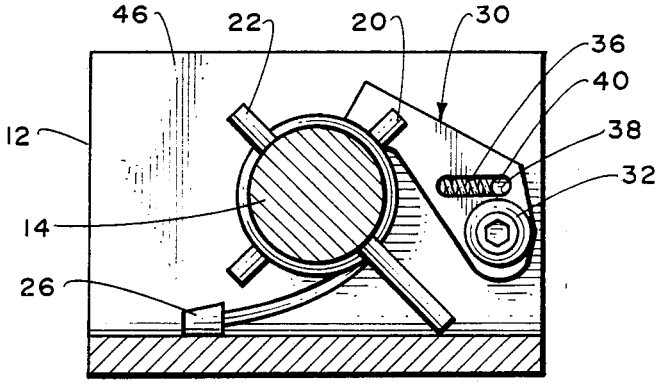
FIG. 4 is a section view of FIG. 3 along the lines 4—4 showing the latching mechanism.

In the actuated or extended position, shown in FIG. 2, stop 18 prevents further movement by abuting against support member 44. In the nonrotated and nonextended position shown in FIG. 1, stop 20 prevents further movement by abuting against support member 46. A torsion spring 24 surrounding bolt 14 is retained and held under tension by pin 22 and the base of support 12. A tapered roller member 26 is adapted to receive the end of the spring that is in contact with the base of support 12 to reduce friction when bolt 14 is moved from one position to another.

Figure 5:
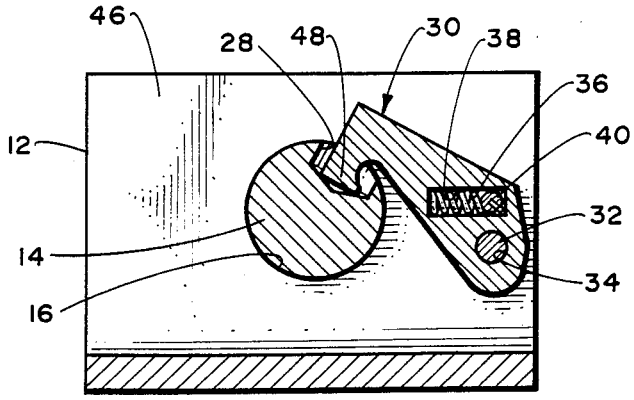
FIG. 5 is a section view of FIG. 3 along line 5—5 showing the latching mechanism in more detail.
Figure 6:
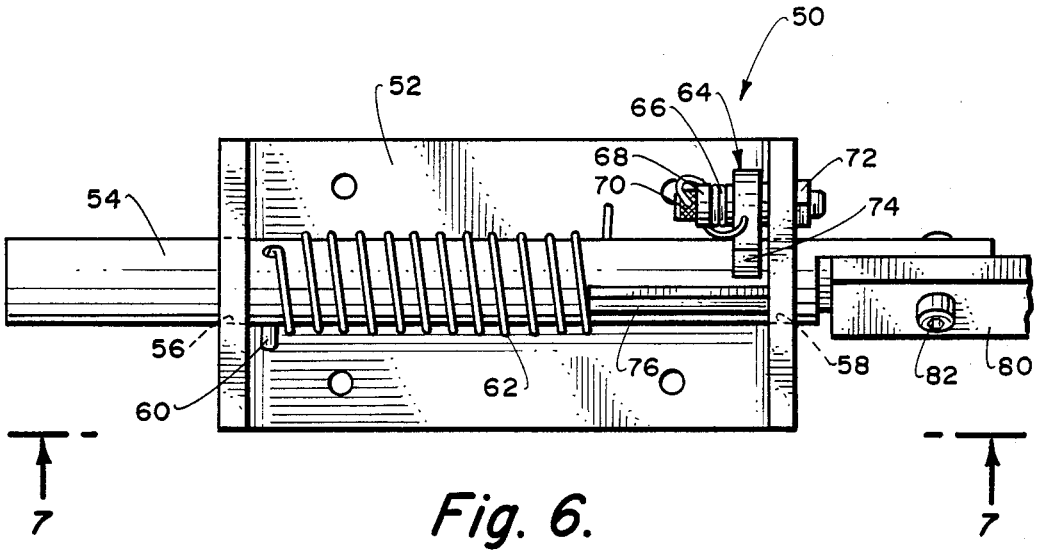
FIG. 6 is a plan view of a second embodiment showing the bolt in the extended and rotated position.
Figure 7:
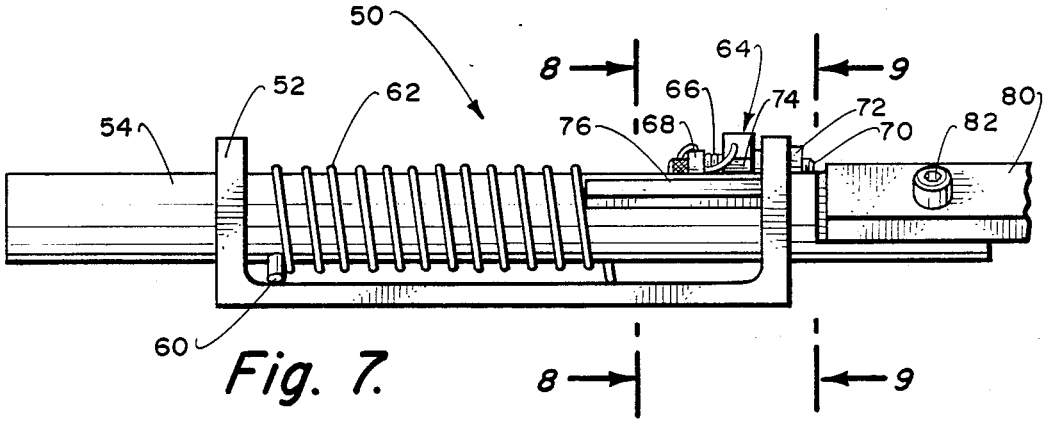
FIG. 7 is a sectional view taken along the lines 7—7 of FIG. 6.
Figure 8:
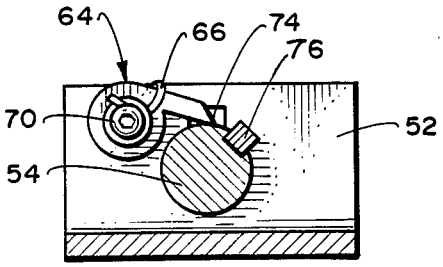
FIG. 8 is a sectional view taken along the lines 8—8 of FIG. 7.
Figure 9:
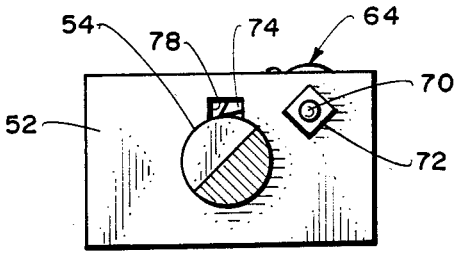
FIG. 9 is a sectional view taken along the lines 9—9 of FIG. 7.

A hole 28 is counter sunk into bolt 14 to receive the end 48 of a locking member 30 (FIG. 5) in a manner to be described below. Locking member 30 is attached to support member 46 by means of a bolt 32. Locking member 30 has a hole 34 through which bolt 32 passes permitting rotation about bolt 32. A spring 36 is positioned in slot 38 of the body of locking member 30 with one end of the spring attached at 40 to support 46. Spring 36 urges locking member 30 to rotate to the left. When bolt is in the nonrotated position, the end 48 of locking member 30 rests on the surface of bolt 14.

In operation, when bolt 14 is in either the extended position (FIG. 2) or nonextended position (FIG. 1), actuating lever 42 prevents the rotation of bolt 14 as urged by spring 24. Bolt 14 can then be moved in a reciprocal fashion to the extended or nonextended position.

In the event the door is attacked and linkage 42 is severed, bolt 14 is free to rotate to the position shown in FIG. 2. When so rotated, the end 48 of locking member 30 is free to move into recess hole 28 in bolt 14. This then relocks bolt 14 so that it cannot be moved to the nonextended position without further damage being done to the assembly 10.

In the embodiment shown in FIGS. 6–9, locking bolt 54 is provided with a key 76 that is free to pass through keyway 78 (FIG. 9) when bolt 54 is held in the nonrotated position. Bolt 54 slides back and forth through holes 56 and 58 in support bracket 52 of the assembly 50. Pin 60 is provided to control the distance bolt 54 can be extended. Bolt 54 is urged to the rotated position by means of spring 62 having one end attached to bolt 54 and the free end resting against the base 52 of support bracket 52. A pawl or locking member 64 is urged to rest on key 62 when it is in the nonrotated position by means of spring 66. If lever 80 is severed and bolt 54 rotates to the rotated position shown, the end 74 of pawl 64 rests on bolt 54. As can be seen this will prevent bolt 54 from being rotated back to the position where key 62 will be in alignment with key-way 78. Bolt 54 is thus re-locked and cannot be withdrawn.

Pawl 64 is attached to support bracket 52 by means of a bolt 70 and nut 72. Spring 66 is held in place by means of a spacer 68.

Obviously many modifications and variation of the present invention are possible in light of the above teachings. It is therefore to be understood that within the scope of the appended claims the invention may be practiced otherwise than as specifically described.

What is claimed is:

1. In a safe or like security closure:

a. An elongated bolt mounted for reciprocation between a forward locking position and a reward unlocking position;

b. bolt-operating means including actuating linkage for said bolt;

c. relocking means for said bolt responsive to the severance of said actuating linkage, said relocking means comprising:

(1) means biasing said bolt to rotate from a first position to a second position when said actuating linkage is severed; and, (2) said bolt having means for preventing the moving of said bolt from the locking position to said unlocking position when rotated to said second position.

2. The apparatus of claim 1 wherein said preventing means includes latching means for preventing said bolt from being rotated once it has been rotated from said first position to said second position.

3. The apparatus of claim 1 wherein said means for preventing the moving of said bolt to the unlocked position is a key that is upstanding from a surface on said bolt and is moved out of register with a key-way when said bolt is rotated to said second position.

4. The apparatus of claim 1 wherein said means for preventing the moving of said bolt to the unlocked position is a recess in said bolt for receiving the end of a moveable pawl when said bolt is rotated to said second position and said bolt is in said locking position.

5. The apparatus of claim 2 wherein said latching means is a lever engaging the key on said bolt.

6. The apparatus of claim 2 wherein said latching means is a recess in said bolt for receiving the end of a moveable pawl when said bolt is rotated to said second position and said bolt is in said locking position.

7. The apparatus of claim 1 wherein said biasing means is a torsional spring surrounding said bolt.

8. The appartus of claim 1 wherein said bolt is configured to reciprocate through a matching slot when in the non-rotated position.

* * * * *